US011756465B2

(12) United States Patent
Kim et al.

(10) Patent No.: US 11,756,465 B2
(45) Date of Patent: Sep. 12, 2023

(54) GATE DRIVING CIRCUIT AND DISPLAY DEVICE INCLUDING THE GATE DRIVING CIRCUIT

(71) Applicant: LG Display Co., Ltd., Seoul (KR)

(72) Inventors: Taegi Kim, Seoul (KR); Min-June Jang, Seoul (KR); Kwangsoo Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/561,255

(22) Filed: Dec. 23, 2021

(65) Prior Publication Data

US 2022/0208059 A1 Jun. 30, 2022

(30) Foreign Application Priority Data

Dec. 28, 2020 (KR) ..... 10-2020-0184123

(51) Int. Cl.
*G09G 3/20* (2006.01)

(52) U.S. Cl.
CPC ..... *G09G 3/20* (2013.01); *G09G 2300/0413* (2013.01); *G09G 2310/0267* (2013.01); *G09G 2310/08* (2013.01); *G09G 2320/0242* (2013.01)

(58) Field of Classification Search
CPC ... G09G 2300/0413; G09G 2310/0267; G09G 2310/08; G09G 2320/0242
See application file for complete search history.

(56) References Cited

U.S. PATENT DOCUMENTS

| | | | | |
|---|---|---|---|---|
| 8,212,802 | B2 | 7/2012 | Jeon | |
| 10,621,938 | B2 | 4/2020 | Tanaka et al. | |
| 11,222,570 | B2 | 1/2022 | Cao | |
| 2006/0061535 | A1 | 3/2006 | Kim et al. | |
| 2012/0306844 | A1 | 12/2012 | Abe et al. | |
| 2013/0286316 | A1 | 10/2013 | Lee | |
| 2018/0018920 | A1 | 1/2018 | Kim et al. | |
| 2020/0074912 | A1 | 3/2020 | Kitsomboonloha et al. | |
| 2020/0175921 | A1* | 6/2020 | Choi | G09G 3/3275 |
| 2020/0175935 | A1* | 6/2020 | Toyota | G09G 3/3688 |
| 2021/0035519 | A1* | 2/2021 | Tagawa | G09G 3/3688 |
| 2021/0057458 | A1* | 2/2021 | Kim | H01L 27/1285 |
| 2021/0082331 | A1* | 3/2021 | Wu | G09G 3/20 |
| 2021/0090514 | A1* | 3/2021 | Wu | G09G 3/3266 |

FOREIGN PATENT DOCUMENTS

| | | | |
|---|---|---|---|
| CN | 108922491 | A | 11/2018 |
| JP | 2019074560 | A | 5/2019 |
| KR | 10-1074402 | B1 | 10/2011 |
| KR | 10-1473843 | B1 | 12/2014 |
| KR | 20160044173 | A | 4/2016 |
| WO | WO 2011148658 | A1 | 12/2011 |

* cited by examiner

*Primary Examiner* — Sejoon Ahn

(74) *Attorney, Agent, or Firm* — SEED IP LAW GROUP LLP

(57) ABSTRACT

A gate driver circuit and a display device including the same have a voltage difference between output lines of the gate driver circuit that is reduced. To this end, a first gate driver is disposed on one side of a display panel, while a second gate driver is disposed on side of the display panel opposite the one side. An odd-numbered output line of the first gate driver is connected to an even-numbered output line of the second gate driver, while an even-numbered output line of the first gate driver is connected to an odd-numbered output line of the second gate driver. Therefore, the voltage difference between the output lines of the gate driver circuit is minimized or reduced.

6 Claims, 6 Drawing Sheets

GATE DRIVING CIRCUIT AND DISPLAY DEVICE INCLUDING THE GATE DRIVING CIRCUIT

CROSS-REFERENCE TO RELATED APPLICATION

This application claims a benefit under 35 U.S.C. § 119(a) of Korean Patent Application No. 10-2020-0184123 filed on Dec. 28, 2020, in the Korean Intellectual Property Office, the entire disclosure of which is incorporated herein by reference for all purposes.

BACKGROUND

Technical Field

The present disclosure relates to a gate driver circuit and a display device including the same, in which a voltage difference between output lines of the gate driver circuit in the display device is reduced.

Description of Related Art

A display device may include a pixel having a light-emissive element and a pixel circuit for driving the light-emissive element.

For example, the pixel circuit includes a driving transistor that controls a driving current flowing through the light-emissive element, and at least one switching transistor that controls (or programs) a gate-source voltage of a driving transistor according to a gate signal.

The switching transistor of the pixel circuit may be switched based on the gate signal output from a gate driver circuit (e.g., GIP) disposed on a substrate of a display panel.

The display device includes a display area where an image is displayed and a non-display area where an image is not displayed. As a size of the non-display area decreases, a size of an edge or a bezel of the display device decreases and a size of the display area increases.

BRIEF SUMMARY

Since the gate driver circuit is disposed in the non-display area in the display device, the size of the display area increases as a size of the gate driver circuit decreases.

The gate driver circuit includes a plurality of stage circuits. Each stage circuit includes a plurality of transistors to generate the gate signal.

In a display device such as LCD or OLED, in a GIP circuit that uses an output stage Q node merge structure, a variation in a transition time, for example, from a high signal to a low signal, between output lines in the Q node is present.

Since the time difference between the output lines of the GIP circuit affects a circuit structure and a panel load, a scheme to reduce the output variation regardless of the load is needed.

Further, when the time difference between the output lines of the GIP circuit is reduced, a size of the transistor may be minimized or reduced and thus a smaller area design of the display device is realized.

Accordingly, in order to address the above technical problems, embodiments of the present disclosure describe a gate driver circuit in which a first gate driver and a second gate driver are respectively disposed on opposing sides of a display panel. An odd-numbered output line of one of the first gate driver and the second gate driver on one of the opposing sides of the display panel is connected to an even-numbered output line of the other of the first gate driver and the second gate driver on the other of the opposing sides of the display panel. An even-numbered output line of one thereof is connected to an odd-numbered output line of the other thereof.

Further, embodiments of the present disclosure describe a display device including a gate driver circuit which supplies a scan signal to each gate line. An odd-numbered output line of a first gate driver and an even-numbered output line of a second gate driver are connected to each other, and an even-numbered output line of the first gate driver and an odd-numbered output line of the second gate driver are connected to each other. The first gate driver is disposed on one side of a display panel, while the second gate driver is disposed on the opposite side of the display panel. A data driver circuit supplies a data voltage to each data line. A timing controller controls operation timing of each of the gate driver circuit and the data driver circuit.

Technical features the present disclosure are not limited to those mentioned above. Other technical features and advantages according to the present disclosure that are not mentioned may be understood based on following descriptions, and may be more clearly understood based on embodiments according to the present disclosure. Further, it will be easily understood that the purposes and advantages according to the present disclosure may be realized using means shown in the claims and combinations thereof.

A gate driver circuit according to an embodiment of the present disclosure may be provided. The gate driver circuit may include a first gate driver disposed on one side of a display panel, and a second gate driver disposed on a side of the display panel opposite the one side. An odd-numbered output line of the first gate driver is connected to an even-numbered output line of the second gate driver, and an even-numbered output line of the first gate driver is connected to an odd-numbered output line of the second gate driver.

Further, a display device according to an embodiment of the present disclosure may be provided. The display device may include: a display panel; a gate driver circuit including a first gate driver disposed on one side of the display panel and a second gate driver disposed on the opposite side of the display panel; a data driver circuit; and a timing controller, wherein an odd-numbered output line of the first gate driver and an even-numbered output line of the second gate driver are connected to each other, and an even-numbered output line of the first gate driver and an odd-numbered output line of the second gate driver are connected to each other.

In accordance with another embodiment, a display device includes a first gate driver and a second gate driver. The first gate driver, in operation, drives a first sub-pixel of a display panel by a first odd-numbered output line coupled to a first gate line, and drives a second sub-pixel of the display panel by a first even-numbered output line coupled to a second gate line. The second gate driver is positioned on a side of the display panel opposite the first gate driver. The second gate driver, in operation, drives the first sub-pixel by a second even-numbered output line coupled to the first gate line, and drives the second sub-pixel by a second odd-numbered output line coupled to the second gate line.

According to an embodiment of the present disclosure, gate drivers are disposed on opposing sides of the display panel in the display device, respectively. The output lines of the gate drivers are connected to each other such that the odd-numbered output lines of the gate driver on one side and the even-numbered output lines of the gate driver on the opposite side are connected to each other, and the even-numbered output lines of the gate driver on one side and the odd-numbered output lines of the gate driver on the opposite side are connected to each other.

Therefore, when the odd-numbered output line of the gate driver on one side and the even-numbered output line of the gate driver on the opposite side are connected to each other, and the even-numbered output line of the gate driver on one side and the odd-numbered output line of the gate driver on the opposite side are connected to each other, an output voltage difference between the output lines of the gate driver circuit may be reduced.

Effects of the present disclosure are not limited to the above-mentioned effects, and other effects as not mentioned will be clearly understood by those skilled in the art from following descriptions.

DETAILED DESCRIPTION

Figure 1:
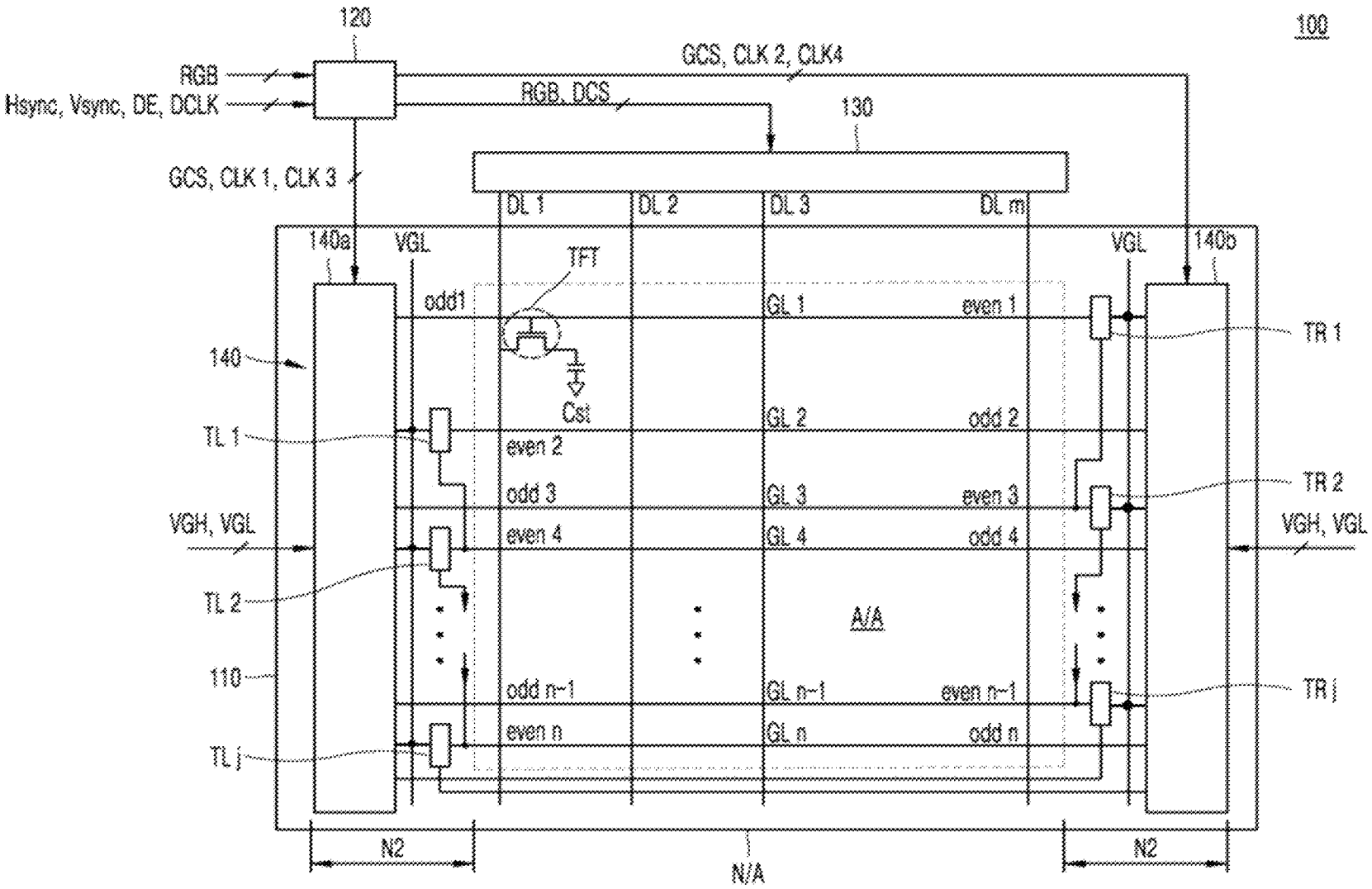
FIG. 1 is a configuration diagram schematically showing an overall configuration of a display device according to an embodiment of the present disclosure.

For simplicity and clarity of illustration, elements in the drawings are not necessarily drawn to scale. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further below. It will be understood that the description herein is not intended to limit the claims to the specific embodiments described. On the contrary, it is intended to cover alternatives, modifications, and equivalents as may be within the spirit and scope of the present disclosure.

A shape, a size, a ratio, an angle, a number, etc., disclosed in the drawings for describing an embodiments of the present disclosure are illustrative, and the present disclosure is not limited thereto. The same reference numerals refer to the same elements herein. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

The terminology used herein is for the purpose of describing particular embodiments only and is not intended to limit the present disclosure. As used herein, the singular form ("a" and "an") is intended to include the plural form as well, unless the context clearly indicates otherwise. It will be further understood that the terms "comprises," "comprising," "includes," and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entirety of list of elements and may not modify the individual elements of the list. When referring to "C to D," this means C inclusive to D inclusive unless otherwise specified.

It will be understood that, although the terms "first," "second," "third," and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to," or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

Unless otherwise defined, all terms including technical and scientific terms used herein have the same meaning as commonly understood by one of ordinary skill in the art to which this concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The features of the various embodiments of the present disclosure may be partially or entirely combined with each other, and may be technically associated with each other or operate with each other. An embodiments may be implemented independently of each other and may be implemented together in an association relationship.

In the present disclosure, each of a sub-pixel circuit and a gate driver circuit formed on a substrate of a display panel may be embodied as a transistor of an n-type MOSFET structure. However, the disclosure is not limited thereto. Each of a sub-pixel circuit and a gate driver circuit formed on a substrate of a display panel may be embodied as a transistor of a p-type MOSFET structure. A transistor may include a gate, a source, and a drain. In the transistor, carriers may flow from the source to the drain. In an n-type transistor, the carrier is an electron and thus a source voltage may be lower than a drain voltage so that electrons may flow from the source to the drain. In an n-type transistor, electrons flow from the source to the drain. A current direction is a direction from the drain to the source. In a p-type transistor, the carrier is a hole. Thus, the source voltage may be higher than the drain voltage so that holes may flow from the source to the drain. In the p-type transistor, the holes flow from the source to the drain. Thus, a direction of current is a direction from the source to the drain. In the transistor of the MOSFET structure, the source and the drain may not be fixed, but may be changed according to an applied voltage. Accordingly, in the present disclosure, one of the source and the drain is referred to as a first source/drain electrode, and the other of the source and the drain is referred to as a second source/drain electrode.

Hereinafter, a preferred example of a gate driver circuit and a display device including the same according to the present disclosure will be described in detail with reference to the accompanying drawings. Across different drawings, the same elements may have the same reference numerals. Moreover, each of scales of components shown in the accompanying drawings is shown to be different from an actual scale for convenience of description. Thus, each of scales of components is not limited to a scale shown in the drawings.

Hereinafter, a gate driver circuit according to an embodiment of the present disclosure and a display device including the same will be described.

FIG. 1 is a configuration diagram schematically showing an overall configuration of a display device according to an embodiment of the present disclosure.

Referring to FIG. 1, a display device 100 according to an embodiment of the present disclosure may include a display panel 110, a timing controller 120, a data driver circuit 130, and a gate driver circuit 140.

The display panel 110 may include an OLED panel that emits light through an organic light emitting diode (OLED) element to display an image or a liquid crystal panel that displays an image through a liquid crystal (LCD) element.

In the display panel 110, a plurality of gate lines GL and a plurality of data lines DL may overlap in a matrix form and may be arranged on a substrate made of glass, and each of a plurality of pixels P may be present at each of regions of overlap between the plurality of gate lines GL and the plurality of data lines DL. Each pixel may include a thin-film transistor TFT and a storage capacitor Cst. All pixels may constitute a single display area A/A. An area in which no pixel is present may be a non-display area N/A.

The display panel 110 may include the plurality of pixels P respectively disposed at regions of overlap between the gate lines GL1 to GLn and the data lines DL1 to DLm. Each of the plurality of pixels P according to one example may be a red pixel, a green pixel, or a blue pixel. In this case, a red pixel, a green pixel, and a blue pixel adjacent to each other may constitute a single unit pixel. According to another example, each of the plurality of pixels P may be a red pixel, a green pixel, a blue pixel, or a white pixel. In this case, a red pixel, a green pixel, a blue pixel, and a white pixel adjacent to each other may constitute a single unit pixel for displaying a single color image. In such a case, the red pixel, the green pixel, the blue pixel and the white pixel may be a red sub-pixel, a green sub-pixel, a blue sub-pixel and a white sub-pixel, respectively, and may be referred to collectively as sub-pixels.

Further, the display panel 110 may include the display area A/A, the non-display area N/A, and a bending area.

The display area A/A may include the plurality of gate lines GL1 to GLn, the plurality of data lines DL1 to DLm, a plurality of reference lines RL, and the plurality of pixels P.

A display mode of the display panel 110 may sequentially display an input image and a black image having a predetermined or selected time difference therebetween on a plurality of horizontal lines. The display mode according to one example may include an image display period or a light-emission display period (IDP) for displaying the input image, and a black display period or an impulse non-light-emission period (BDP) for displaying the black image.

A sensing mode or a real-time sensing mode of the display panel 110 may sense operation characteristics of each of the pixels P arranged in a single horizontal line among a plurality of horizontal lines after the image display period IDP within one frame, and may update a pixel-based compensation value for compensating for a variation in the operation characteristics of a corresponding pixels P based on a sensed value. The sensing mode according to one example may sense the operation characteristics of each of the pixels P arrange in a single horizontal line among a plurality of horizontal lines according to an irregular sequence within a vertical blank period (VBP) of each frame. The pixels P that are emitting light according to the display mode do not emit light in the sensing mode. Thus, when sequentially sensing the horizontal lines in the sensing mode, line dim may occur in the horizontal line being sensed due to the non-light emission thereof. To the contrary, when sensing the horizontal lines in an irregular or random sequence in the sensing mode, the line dim may be minimized, reduced or prevented due to a visual spreading effect.

The timing controller 120 may receive an image signal RGB as transmitted from an external system, and timing signals such as a clock signal CLK, a horizontal synchronization signal Hsync, a vertical synchronization signal Vsync, and a data enable signal DE, and may generate a control signal to control the data driver circuit 130 and the gate driver circuit 140 based on the received signals. The timing controller 120 may be timing controller circuitry, and may be referred to as the timing controller circuitry.

In this connection, the horizontal sync signal Hsync refers to a signal representing a time it takes to display one horizontal line of a screen, and the vertical sync signal Vsync refers to a signal representing a time it takes to display a screen of one frame. Further, the data enable signal DE refers to a signal indicating a period for which a data voltage is supplied to the pixel P of the display panel 110.

Further, the timing controller 120 may generate a gate control signal GCS to control the gate driver circuit 140 and a data control signal DCS to control the data driver circuit 130 in synchronization with the input timing signals.

In addition, the timing controller 120 may generate a plurality of clock signals CLK 1, CLK 2, CLK 3, CLK 4 (or collectively "clock signals CLK 1 to CLK 4) that determine an operation timing of each of stages of the gate driver circuit 140, and may provide the plurality of clock signals CLK 1 to CLK 4 to the gate driver circuit 140. In this connection, each of the first to fourth clock signals CLK 1 to CLK 4 has a high period which lasts for two horizontal periods (2H). Temporarily adjacent ones of the first to fourth clock signals CLK 1 to CLK 4 may overlap each other by one horizontal period (1H).

Moreover, the timing controller 120 may align and modulate the received image data RGB into a form that the data driver circuit 130 may process and output the modulated data. In this connection, the aligned image data RGB may have a form to which a color coordinate correction algorithm for image quality improvement is applied.

In response to the data control signal DCS input from the timing controller 120, the data driver circuit 130 may selectively convert the input digitally modulated image data RGB into an analog data voltage VDATA based on a reference voltage Vref and provide the converted data voltage. The analog data voltage VDATA may be latched on a single horizontal line basis and then may be simultaneously input to the display panel 110 via all of the data lines DL 1 to DL m for a single horizontal period (1H).

The gate driver circuit 140 may supply a scan signal to each of the gate lines GL1 to GLn.

The gate driver circuit 140 may include a first gate driver 140*a* and a second gate driver 140*b*.

The gate driver circuit 140 may include two gate drivers, that is, the first gate driver 140*a* and the second gate driver 140*b*, which may be respectively disposed on both opposing ends of the display panel 110 and in the non-display area N/A.

In one example, the first gate driver 140*a* may be disposed on one side (left side) of the display panel 110 and the second gate driver 140*b* may be disposed on the opposite side (right side) of the display panel 110.

In this connection, in the gate driver circuit 140, an odd-numbered output line of the first gate driver 140*a* may be connected to an even-numbered output line of the second gate driver 140*b*, while an even-numbered output line of the first gate driver 140*a* may be connected to an odd-numbered output line of the second gate driver 140*b*. It should be understood that an output line of the first gate driver 140*a* and an output line of the second gate driver 140*b* being "connected" includes configurations in which the output line of the first gate driver 140*a* is the same as or different from the output line of the second gate driver 140*b*. For example, the odd-numbered output line of the first gate driver 140*a* and the even-numbered output line of the second gate driver 140*b* may be a single, continuous output line. For example, the single, continuous output line may be a single, continuous trace formed in a deposition process. The single, continuous output line may have one end coupled to circuitry of the first gate driver 140*a*, and another end coupled to circuitry of the second gate driver 140*b*. In another example, the odd-numbered output line of the first gate driver 140*a* and the even-numbered output line of the second gate driver 140*b* may be two output lines electrically connected through an intermediate structure, such as a via, a bridge, a pad, other traces or a combination thereof.

Each of the gate drivers 140*a* and 140*b* may include at least one stage, preferably, a plurality of stages, each stage including a shift register. This gate driver circuit 140 may be embedded in the non-display area and in a form of a thin-film pattern and in a gate-in-panel (GIP) manner during a manufacturing process of a substrate of the display panel 110.

The first and the second gate drivers 140*a* and 140*b* may alternately output a gate high voltage VGH every two horizontal periods (2H) via the plurality of gate lines GL1 to GLn formed on the display panel 110 in response to the gate control signal GCS input from the timing controller 120. In this connection, the outputting the gate high voltage VGH may be maintained for the two horizontal periods (2H). Temporarily adjacent the gate high voltages VGH may overlap each other by one horizontal period (1H). This is intended for pre-charging the gate lines GL1 to GLn. Thus, more stable pixel charging may be performed upon application of the data voltage.

To this end, the first and third clock signals CLK1 and CLK3, each having the two horizontal periods (2H), may be applied to the first gate driver 140*a*, while the second and fourth clock signals CLK2 and CLK4, each having the two horizontal periods (2H), may be applied to the second gate driver 140*b*. In this connection, the second and fourth clock signals CLK2 and CLK4 may respectively overlap the first and third clock signals CLK1 and CLK3 for one horizontal period (1H).

In one example, the first gate driver 140*a* may output the gate high voltage VGH to an n-th gate line GLn. Then, after one horizontal period (1H), the second gate driver 140*b* may output the gate high voltage VGH to an (n+1)-th gate line GLn+1.

Next, after one horizontal period (1H), the first gate driver 140*a* may output the gate high voltage VGH to an (n+2)-th gate line GLn+2. At the same time, the first gate driver 140*a* may output a gate low voltage VGL to the n-th gate line GLn to turn off a thin-film transistor TFT so that a data voltage charged in the storage capacitor Cst is maintained for one frame.

In an embodiment of the present disclosure, discharging circuits TL1, TL2, . . . TLj, TR1, TR2, . . . TRj may be activated at a time-point at which a voltage of the gate line GLn is switched from the gate high voltage VGH to the low voltage VGL to minimize or reduce a discharge delay of the gate line GLn.

In this connection, each discharging circuit may be connected to a distal end of each of the gate lines GL1 to GLn. Thus, R (right) discharging circuits TR1 to TRj (j is a natural number) respectively connected to odd-number-th gate lines GL2n−1 may be disposed adjacent to the second gate driver 140*b*. L (left) discharging circuits TL1 to TLj respectively connected to even-number-th gate lines GL2*n* may be disposed adjacent to the first gate driver 140*a*.

In this connection, each of the discharging circuits TL1 to TLj, and TR1 to TRj may be connected to a gate line GLn+2 second subsequent to a single gate line GLn and may apply the gate low voltage VGL to the corresponding gate line GLn.

Each of these discharging circuits TL1 to TLj and TR1 to TRj may be embodied as a thin-film transistor between adjacent ones of stages constituting the gate driver 140. Thus, a narrow bezel (a size of a portion (2×N2) of the non-display area N/A of the display panel 110) in which the gate drivers 140*a* and 140*b* are occupied may be realized.

Figure 2:
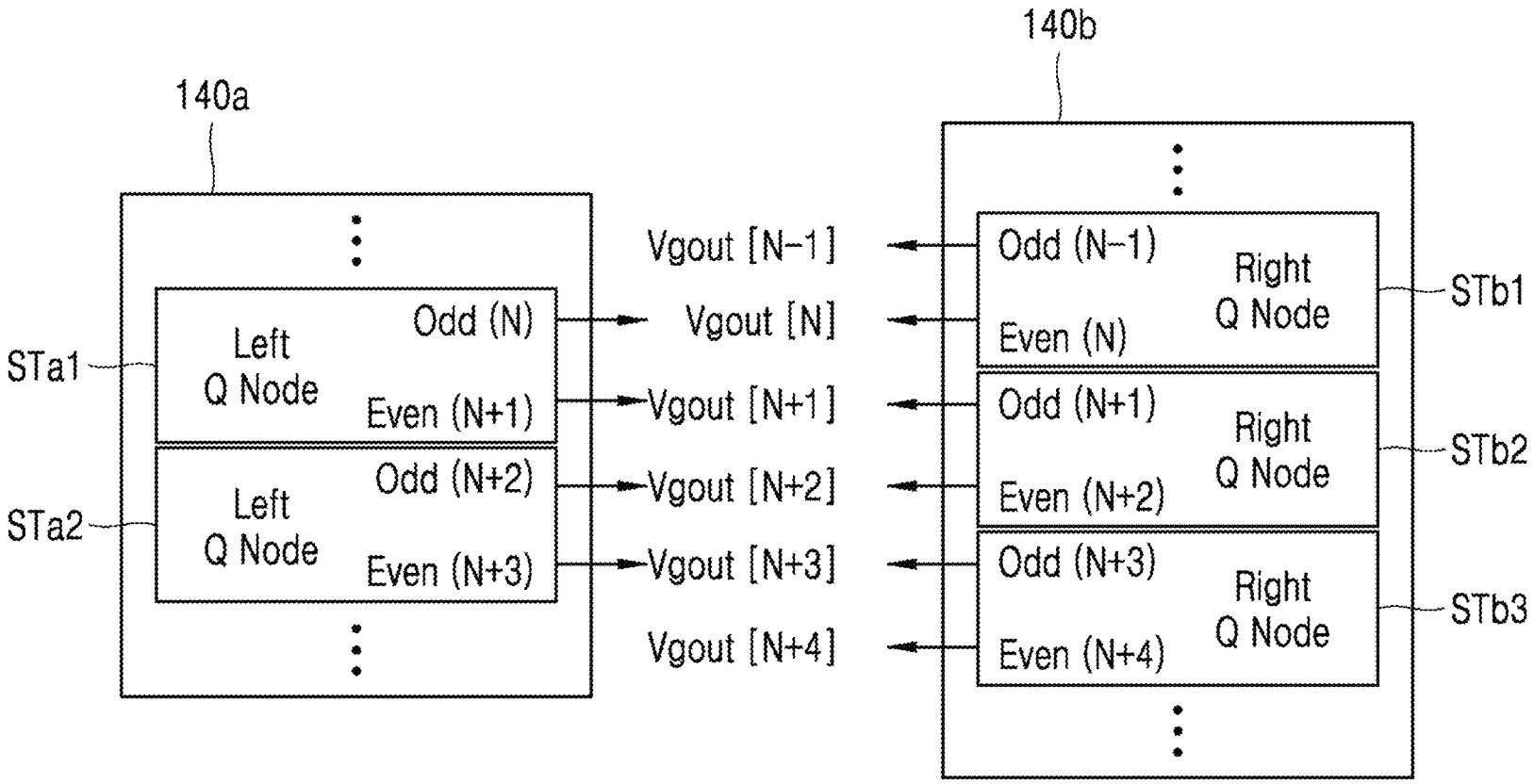
FIG. 2 is a diagram showing an output line connection configuration between stages of a first gate driver and a second gate driver shown in FIG. 1, in which each stage has two line outputs.

FIG. 2 is a diagram showing an output line connection configuration between stages of a first gate driver and a second gate driver shown in FIG. 1, in which each stage has two line outputs.

Referring to FIG. 2, the first gate driver 140*a* according to an embodiment of the present disclosure may include at least one stage STa1, STa2, . . . , Stan. The second gate driver 140*b* according to an embodiment of the present disclosure may include at least one stage STb1, STb2, STb3, . . . , STbn.

Each of the stages STa1, STa2, . . . , STan of the first gate driver 140*a* may include two output lines: an odd-numbered output line and an even-numbered output line.

In one example, the first stage STa1 in the first gate driver 140*a* may constitute a left Q node of the display panel 110, and may include an N-th output line Vgout[N] and an (N+1)-th output line Vgout[N+1]. In this connection, the N-th output line Vgout[N] may be embodied as an odd-numbered output line Odd(N), while the (N+1)-th output line Vgout[N+1] may be embodied as an even-numbered output line Even(N+1).

In one example, the second stage STa2 in the first gate driver 140*a* may constitute a left Q node of the display panel 110, and may include an (N+2)-th output line Vgout[N+2] and an (N+3)-th output line Vgout[N+3]. In this connection, the (N+2)-th output line Vgout[N+2] may be embodied as an odd-numbered output line Odd(N+2), while the (N+3)-th output line Vgout[N+3] may be embodied as an even-numbered output line Even(N+3).

In the second gate driver 140*b*, each of the stages STb1, STb2, STb3, . . . , STbn may include two output lines: an odd-numbered output line and an even-numbered output line.

In one example, the first stage STb1 in the second gate driver 140*b* may constitute a right Q node of the display panel 110, and may include an (N−1)-th output line Vgout [N−1] and an N-th output line Vgout[N]. In this connection, the (N−1)-th output line Vgout[N−1] may be embodied as an odd-numbered output line Odd(N−1), while the N-th output line Vgout[N] may be embodied as an even-numbered output line Even(N).

In one example, the second stage STb2 in the second gate driver 140*b* may constitute a right Q node of the display panel 110, and may include an (N+1)-th output lines Vgout [N+1] and an (N+2)-th Output line Vgout[N+2]. In this connection, the (N+1)-th output line Vgout[N+1] may be embodied as an odd-numbered output line Odd(N+1), while the (N+2)-th output line Vgout[N+2] may be embodied as an even-numbered output line Even(N+2).

In one example, the third stage STb3 in the second gate driver 140*b* may constitute a right Q node of the display panel 110, and may include an (N+3)-th output lines Vgout [N+3] and an (N+4)-th Output line Vgout[N+4]. In this connection, the (N+3)-th output line Vgout[N+3] may be embodied as an odd-numbered output line Odd(N+3), while the (N+4)-th output line Vgout[N+4] may be embodied as an even-numbered output line Even(N+4).

In the above configuration, the odd-numbered output line of each of the stages STa1, STa2, . . . , STan of the first gate driver 140*a* may be connected to the even-numbered output line of each of the stages STb1, STb2, STb3, STbn of the second gate driver 140*b*.

In one example, the N-th odd-numbered output line odd[N] of the first stage STa1 in the first gate driver 140*a* may be connected to the N-th even-numbered output line Even [N] of the first stage STb1 of the second gate driver 140*b*.

In one example, the (N+2)-th odd-numbered output line Odd [N+2] of the second stage STa2 in the first gate driver 140*a* may be connected to the (N+2)-th even-numbered output line Even [N+2] of the second stage STb2 of the second gate driver 140*b*.

In one example, the even-numbered output lines of each of the stages STa1, STa2, . . . , STan of the first gate driver 140*a* may be connected to the odd-numbered output line of each of the stages STb1, STb2, STb3, . . . , STbn of the second gate driver 140*b*.

In one example, the (N+1)-th even-numbered output line [N+1] of the first stage STa1 in the first gate driver 140*a* may be connected to the (N+1)-th odd-numbered output line Odd [N+1] of the second stage STb2 of the second gate driver 140*b*.

In one example, the (N+3)-th even-numbered output line Even [N+3] of the second stage STa2 in the first gate driver 140*a* may be connected to the (N+3)-th odd-numbered output line Odd [N+3] of the third stage STb3 of the second gate driver 140*b*.

Figure 3:
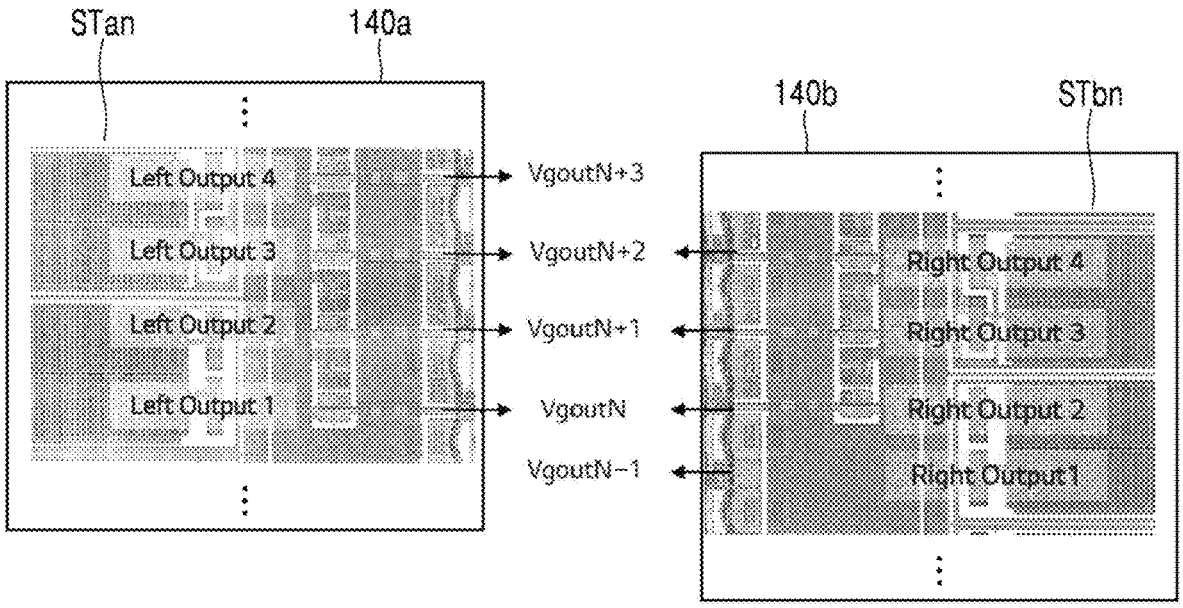
FIG. 3 is a diagram showing a first gate driver and a second gate driver in a gate driver circuit according to an embodiment of the present disclosure, in which each of the first gate driver and the second gate driver has a stage having four line outputs.
Figure 4:
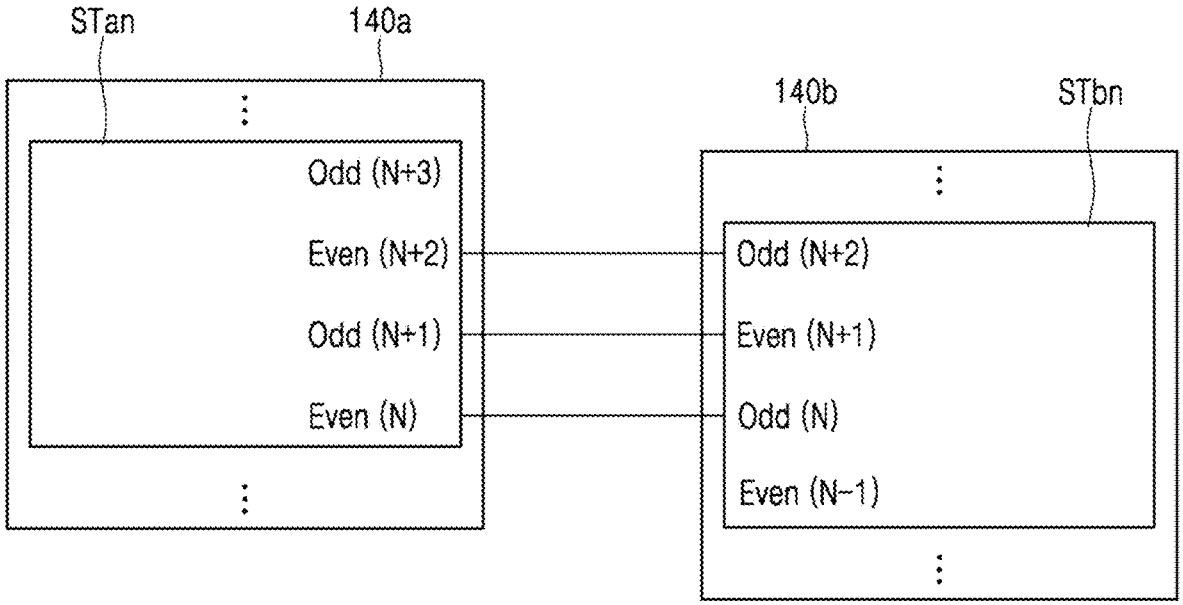
FIG. 4 is a diagram showing an output line connection configuration between stages of the first gate driver and the second gate driver in FIG. 3.

FIG. 3 is a diagram showing a first gate driver and a second gate driver in a gate driver circuit according to an embodiment of the present disclosure, in which each of the first gate driver and the second gate driver has a stage having four line outputs. FIG. 4 is a diagram showing an output line connection configuration between stages of the first gate driver and the second gate driver in FIG. 3.

Referring to FIG. 3 and FIG. 4, the first gate driver 140*a* according to an embodiment of the present disclosure may include at least one stage STa1, STa2, . . . , Stan. The second gate driver 140*b* according to an embodiment of the present disclosure may include at least one stage STb1, STb2, STb3, . . . , STbn.

A single stage STan in the first gate driver 140*a* may include four output lines VgoutN, VgoutN+1, VgoutN+2, and VgoutN+3, while a single stage STbn in the second gate driver 140*b* may include four outputs lines VgoutN−1, VgoutN, VgoutN+1, and VgoutN+2.

In one example, the N-th stage STan in the first gate driver 140*a* that outputs a voltage control signal on the left side of the display panel 110 may have four output lines including an N-th output line VgoutN, an (N+1)-th output line VgoutN+1, an (N+2)-th output line VgoutN+2, and an (N+3)-th output line VgoutN+3. Further, the N-th stage STbn in the second gate driver 140*b* that outputs a voltage control signal on the right side of the display panel 110 may have four output lines including an (N−1)-th output line VgoutN−1, an N-th output line VgoutN, an (N+1)-th output line VgoutN+1, and an (N+2)-th output line VgoutN+2.

Each of the stages STa1, STa2, . . . , STan of the first gate driver 140*a* may include four output lines including odd-numbered output lines and even-numbered output lines.

Each of the stages STb1, STb2, STb3, . . . , STbn in the second gate driver 140*b* may include four output lines including odd-numbered output lines and even-numbered output lines.

An odd-numbered output line of each stage STan of the first gate driver 140*a* may be connected to an even-numbered output line of each stage STbn of the second gate driver 140*b*.

In one example, in FIG. 4, the (N+1)-th odd-numbered output line Odd [N+1] of the N-th stage STan of the first gate driver 140*a* may be connected to the (N+1)-th even-numbered output line Even [N+1] of the N-th stage STbn of the second gate driver 140*b*.

Further, an even-numbered output line of each stage STan of the first gate driver 140*a* may be connected to an odd-numbered output line of each stage STbn of the second gate driver 140*b*.

In one example, in FIG. 4, the N-th even-numbered output line Even [N] of the N-th stage STan of the first gate driver 140*a* may be connected to the N-th odd-numbered output line Odd [N] of the N-th stage STbn of the second gate driver 140*b*. Further, in FIG. 4, the (N+2)-th even-numbered output line Even [N+2] of the N-th stage STan of the first gate driver 140*a* may be connected to the (N+2)-th odd-numbered output line Odd [N+2] of the N-th stage STbn of the second gate driver 140*b*.

Figure 5:
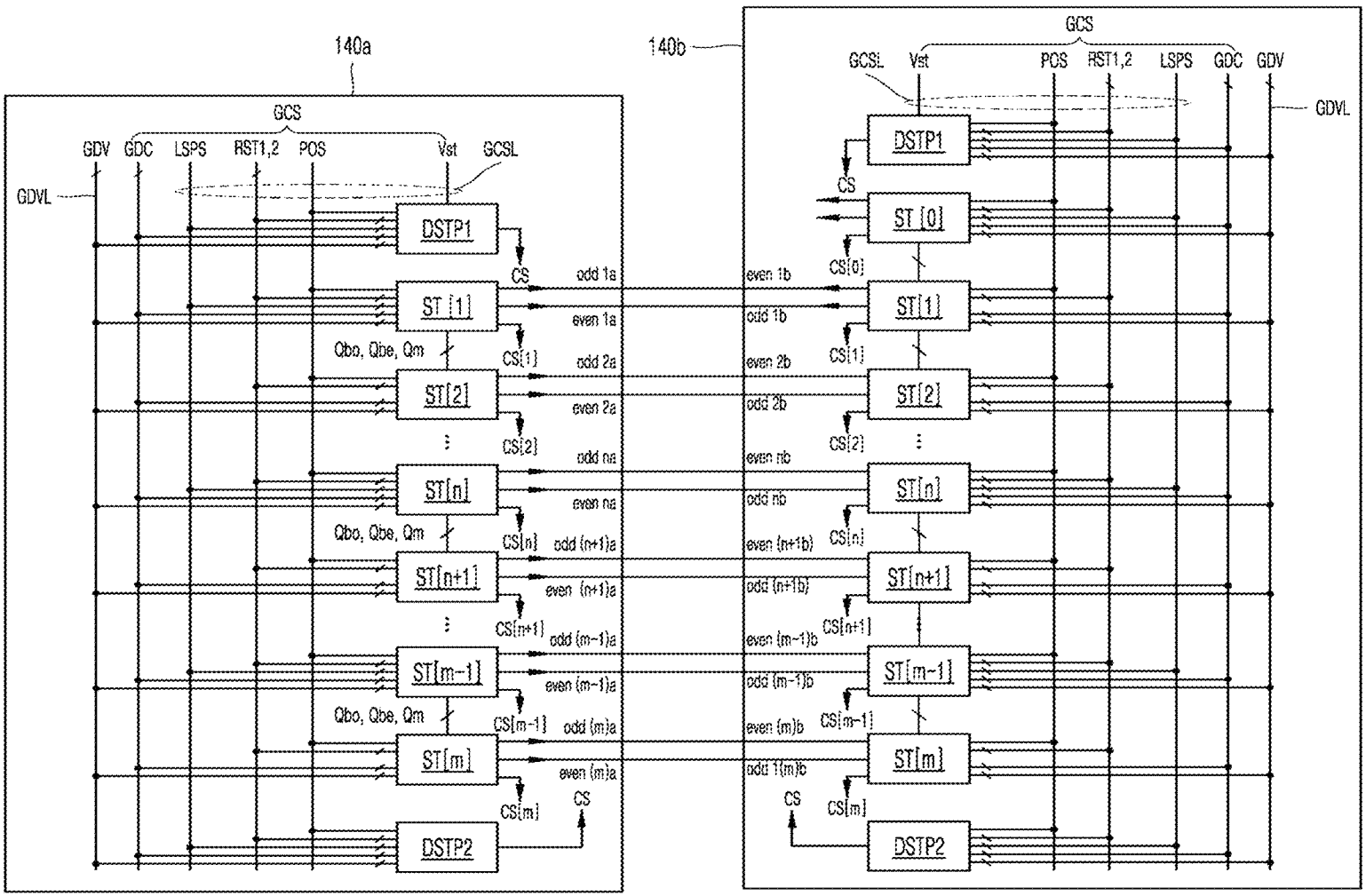
FIG. 5 is a diagram showing an output line connection configuration between stages of a first gate driver and a second gate driver according to an embodiment of the present disclosure.

FIG. 5 is a diagram showing an output line connection configuration between stages of a first gate driver and a second gate driver according to an embodiment of the present disclosure.

Referring to FIG. 5, each of the first gate driver 140*a* and the second gate driver 140*b* according to an embodiment of the present disclosure may include a gate control signal line GCSL, a gate driving voltage line GDVL, and first to m-th stage circuits ST[1] to ST[m].

Further, each of the first gate driver 140*a* and the second gate driver 140*b* may further include a front dummy stage circuitry DSTP1 disposed in front of the first stage circuit ST[1], and a rear dummy stage circuitry DSTP2 disposed in rear of the m-th stage circuit ST[m]. In this connection, the second gate driver 140*b* may further include a zero stage ST[0] such that the second gate driver 140*b* starts to operate earlier by half a period or one period than the first gate driver 140*a* starts to operate.

A first odd-numbered output line odd 1*a* of the first stage circuit ST[1] of the first gate driver 140*a* may be connected to a first even-numbered output line even 1*b* of the first stage circuit ST[1] of the second gate driver 140*b*.

A first even-numbered output line even 1*a* of the first stage circuit ST[1] of the first gate driver 140*a* may be connected to a first odd-numbered output line odd 1*b* of the first stage circuit ST[1] of the second gate driver 140*b*.

A second odd-numbered output line odd 2*a* of the second stage circuit ST[2] of the first gate driver 140*a* may be connected to a second even-numbered output line even 2*b* of the second stage circuit ST[1] of the second gate driver 140*b*.

A second even-numbered output line even 2*a* of the second stage circuit ST[2] of the first gate driver 140*a* may be connected to a second odd-numbered output line odd 2*b* of the second stage circuit ST[2] of the second gate driver 140*b*.

An n-th odd-numbered output line odd na of the n-th stage circuit ST[n] of the first gate driver 140*a* may be connected to an n-th even-numbered output line even nb of the n-th stage circuit ST[n] of the second gate driver 140*b*.

An n-th even-numbered output line even na of the n-th stage circuit ST[n] of the first gate driver 140*a* may be connected to an n-th odd-numbered output line odd nb of the n-th stage circuit ST[n] of the second gate driver 140*b*.

An (n+1)-th odd-numbered output line odd [n+1]a of the (n+1)-th stage circuit ST[n+1] of the first gate driver 140*a* may be connected to an n-th even-numbered output line even nb of the (n+1)-th stage circuit ST[n+1] of second gate driver 140*b*.

An n-th even-numbered output line even na of the n-th stage circuit ST[n] of the first gate driver 140*a* may be connected to an (n+1)-th odd-numbered output line odd [n+1]b of the (n+1)-th stage circuit ST[n+1] of the second gate driver 140*b*.

An (m−1)-th odd-numbered output line odd [m−1]a of the (m−1)-th stage circuit ST[m−1] of the first gate driver 140*a* may be connected to the (m−1)-th even-numbered output line even [m−1]b of the (m−1)-th stage circuit ST[m−1] of the second gate driver 140*b*.

An (m−1)-th even-numbered output line even [m−1]a of the (m−1)-th stage circuit ST[m−1] of the first gate driver 140*a* may be connected to the (m−1)-th odd-numbered output line odd [m−1]b of the (m−1)-th stage circuit ST[m−1] of the second gate driver 140*b*.

An m-th odd-numbered output line odd [m]a of the m-th stage circuit ST[m] of the first gate driver 140*a* may be connected to an m-th even-numbered output line even [m]b of the m-th stage circuit ST[m] of the second gate driver 140*b*.

An m-th even-numbered output line even [m]a of the m-th stage circuit ST[m] of the first gate driver 140*a* may be connected to an m-th odd-numbered output line odd [m]b of the m-th stage circuit ST[m] of the second gate driver 140*b*.

The gate control signal line GCSL receives the gate control signal GCS supplied from the timing controller 120. The gate control signal line GCSL according to one example may include a gate start signal line, a first rest signal line, a second rest signal line, a plurality of gate driving clock lines, a display panel on signal line, and a sensing preparation signal line.

The gate start signal line may receive a gate start signal Vst supplied from the timing controller 120. In one example, the gate start signal line may be connected to the front dummy stage circuitry DSTP1.

The first rest signal line may receive a first rest signal RST1 supplied from the timing controller 300. The second rest signal line may receive a second rest signal RST2 supplied from the timing controller 300. In one example, each of the first and second rest signal lines may be commonly connected to the front dummy stage circuitry DSTP1, the first to m-th stage circuits ST[1] to ST[m], and the rear dummy stage circuitry DSTP2.

The plurality of gate driving clock lines may respectively include a plurality of carry clock lines, a plurality of scan clock lines, and a plurality of sense clocks which may receive, respectively, a plurality of carry shift clocks, a plurality of scan shift clocks, and a plurality of sense shift clocks from the timing controller 300. The clock lines respectively included in the plurality of gate driving clock lines may be selectively connected to the front dummy stage circuitry DSTP1, the first to m-th stage circuits ST[1] to ST[m], and the rear dummy stage circuitry DSTP2.

The display panel on signal line may receive a display panel on signal POS supplied from the timing controller 120. In one example, the display panel on signal line may be commonly connected to the front dummy stage circuitry DSTP1 and the first to m-th stage circuits ST[1] to ST[m].

The sensing preparation signal line may receive a line sensing preparation signal LSPS supplied from the timing controller 300. In one example, the sensing preparation signal line may be commonly connected to the first to m-th stage circuits ST[1] to ST[m]. Optionally, the sensing preparation signal line may be additionally connected to the front dummy stage circuitry DSTP1.

The gate driving voltage line GDVL may include first, second, third and fourth gate high-potential voltage lines for receiving respectively first, second, third and fourth gate high-potential voltages having different voltage levels from a power supply circuit, and first, second and third gate low-potential voltage lines that receive respectively first, second and third gate low-potential voltages having different voltage levels from the power supply circuit.

According to one example, the first gate high-potential voltage may have a higher voltage level than that of the second gate high-potential voltage. The third and fourth gate high-potential voltages may swing or be inverted in a reversed manner to each other between a high voltage (or TFT on voltage or first voltage) and a low voltage (or TFT off voltage or second voltage) for AC operation. In one example, while the third gate high-potential voltage (or gate odd high-potential voltage) may have a high voltage, the fourth gate high-potential voltage (or gate even high-potential voltage) may have a low voltage. Moreover, while the third gate high-potential voltage may have a low voltage, the fourth gate high-potential voltage may have a high voltage.

Each of the first and second gate high-potential voltage lines may be commonly connected to the first to m-th stage circuits ST[1] to ST[m], the front dummy stage circuitry DSTP1, and the rear dummy stage circuitry DSTP2.

The third gate high-potential voltage line may be commonly connected to odd-number-th stage circuits among the first to m-th stage circuits ST[1] to ST[m], and may be commonly connected to odd-number-th dummy stage circuits of each of the front dummy stage circuitry DSTP1 and the rear dummy stage circuitry DSTP2.

The fourth gate high-potential voltage line may be commonly connected to even-number-th stage circuits among the first to m-th stage circuits ST[1] to ST[m], and may be commonly connected to even-number-th dummy stage circuits of each of the front dummy stage circuitry DSTP1 and the rear dummy stage circuitry DSTP2.

According to one example, the first gate low-potential voltage and the second gate low-potential voltage may have substantially the same voltage level. The third gate low-potential voltage may have a TFT off voltage level. The first gate low-potential voltage may have a higher voltage level than that of the third gate low-potential voltage. In one example of the present disclosure, the first gate low-potential voltage may be set to a voltage level higher than that of the third gate low-potential voltage, thereby reliably blocking an off current of a TFT having a gate electrode connected to a control node of a stage circuit to be described later, such that stability and reliability of an operation of the TFT may be secured.

Each of the first to third gate low-potential voltage lines may be commonly connected to the first to m-th stage circuits ST[1] to ST[m].

The front dummy stage circuitry DSTP1 may sequentially generate a plurality of front carry signals in response to the gate start signal Vst supplied from the timing controller 120 and may supply the plurality of front carry signals as a front carry signal or a gate start signal to one of the rear stages.

The rear dummy stage circuitry DSTP2 may sequentially generate a plurality of rear carry signals in response to the gate start signal Vst supplied from the timing controller 120 and may supply the plurality of rear carry signals as a rear carry signal or a stage rest signal to one of the front stages.

The first to m-th stage circuits ST[1] to ST[m] may be dependently connected to each other. The first to m-th stage circuits ST[1] to ST[m] may respectively generate first to m-th scan signals SC[1] to SC[m] and first to m-th sense signals SE[1] to SE[m] and output the same to a corresponding gate line group GLG disposed on the light-emissive display panel 100. Moreover, the first to m-th stage circuits ST[1] to ST[m] may respectively generate first to m-th carry signals CS[1] to CS[m], and then may supply the front carry signal or the gate start signal to one of the rear stages, and at the same time, may supply the rear carry signal or the stage rest signal to one of the front stages.

Two adjacent stages ST[n] and ST[n+1] among the first to m-th stage circuits ST[1] to ST[m] may share a portion of a sensing control circuit and a control node Qbo, Qbe, and Qm. Accordingly, a circuit configuration of the gate driver circuit 140 may be simplified, and an area of a portion of the display panel 110 as occupied by the gate driver circuit 140 may be reduced.

Figure 6:
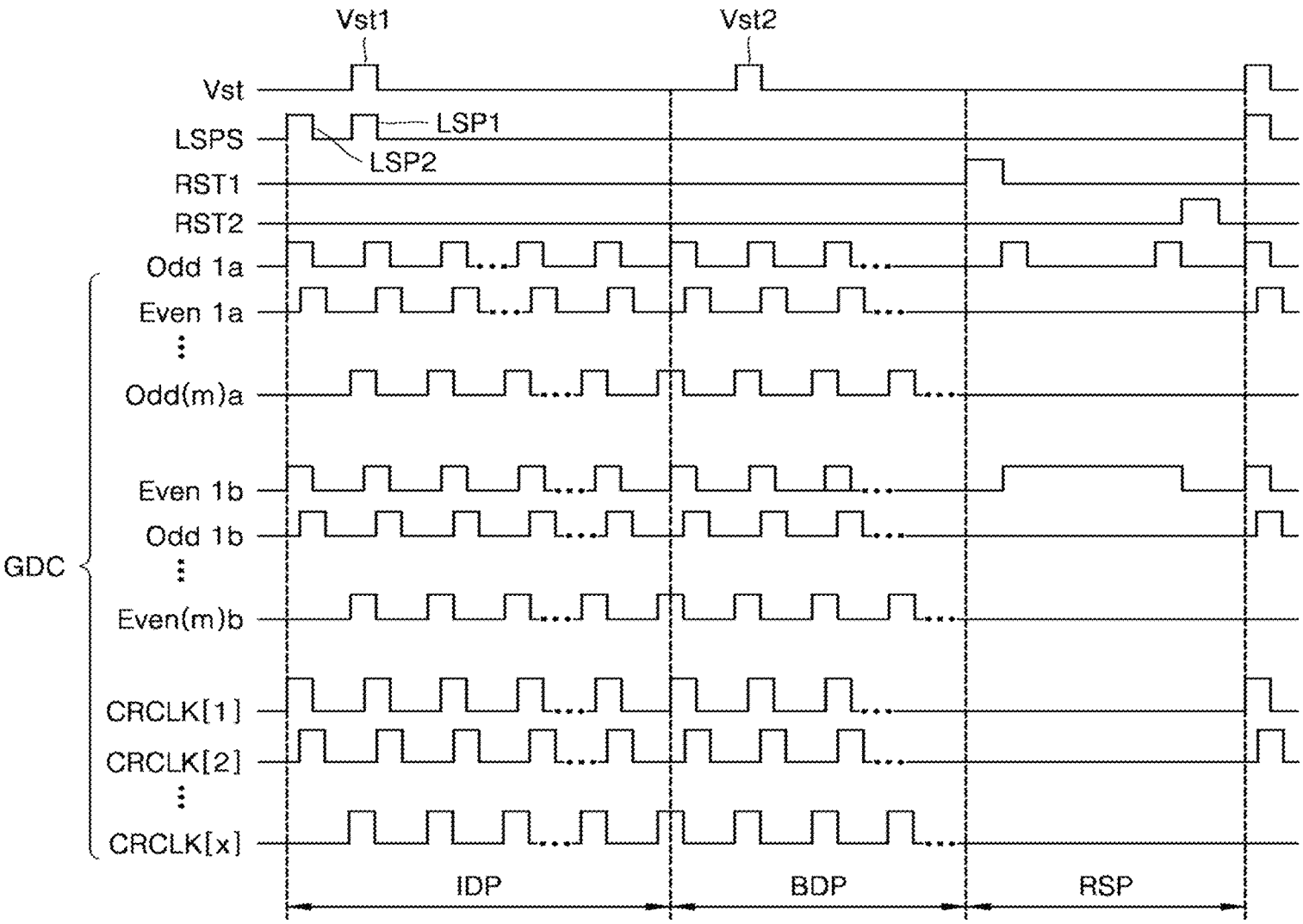
FIG. 6 is a signal waveform diagram showing a signal output from an output line of each of the first gate driver and the second gate driver according to an embodiment of the present disclosure.

FIG. 6 is a signal waveform diagram showing a signal output from an output line of each of the first gate driver and the second gate driver according to an embodiment of the present disclosure.

Referring to FIG. 6, the gate control signal GCS applied to the gate control signal line of each of the first gate driver 140*a* and the second gate driver 140*b* according to an embodiment of the present disclosure may include the gate start signal Vst, the line sensing preparation signal LSPS, the first rest signal RST1, the second rest signal RST2, the display panel on signal POS, and the plurality of gate driving clocks GDC.

The gate start signal Vst refers to a signal that controls a start time-point of each of the image display period IDP and the black display period BDP of each frame. The gate start signal Vst may be issued at a start time-point of each of the image display period IDP and the black display period BDP. For example, the gate start signal Vst may be issued twice every frame.

The gate start signal Vst according to one example may include a first gate start pulse (or gate start pulse for image display) Vst1 issued at the start time-point of the image display period IDP within one frame, and a second gate start pulse (or gate start pulse for black display) Vst2 issued at the start time-point of the black display period BDP.

The line sensing preparation signal LSPS may be issued irregularly or randomly within the image display period IDP of every frame. A line sensing preparation signal LSPS at a start time-point of a current frame may be different from a line sensing preparation signal LSPS at a start time-point of a previous frame.

The line sensing preparation signal LSPS according to one example may include a line sensing selection pulse LSP1 and a line sensing cancellation pulse LSP2. The line sensing selection pulse LSP1 may refer to a signal for selecting one horizontal line to be sensed among a plurality of horizontal lines. The line sensing selection pulse LSP1 may be synchronized with the first gate start pulse or the front carry signal supplied as a gate start signal to one of the stage circuits ST[1] to ST[m]. The line sensing selection pulse LSP1 may be referred to as a sensing line pre-charging control signal. The line sensing cancellation pulse LSP1 may refer to a signal for canceling a line sensing of the horizontal line on which the sensing operation has been completed. The line sensing cancellation pulse LSP1 may be issued between an end time-point of a sensing period RSP and an issuance time-point of the line sensing selection pulse LSP1.

The first rest signal RST1 may be issued at a start time-point of the sensing mode. The second rest signal RST2 may be issued at an end time-point of the sensing mode. Optionally, the second rest signal RST2 may be omitted or may be the same as the first rest signal RST1.

An output pulse signal Odd 1*a* output from the first odd-numbered output line odd 1*a* of the first stage circuit ST[1] of the first gate driver 140*a* may be the same as an output pulse signal Even 1*b* output from the first even-numbered output line even 1*b* of the first stage circuit ST[1] of the second gate driver 140*b* connected to the first odd-numbered output line odd 1*a*. Thus, the output pulse signal Odd 1*a* and the output pulse signal Even 1*b* may have the same period and the same magnitude.

An output pulse signal Even 1*a* output from the first even-numbered output line even 1*a* of the first stage circuit ST[1] of the first gate driver 140*a* may be same as an output pulse signal Odd 1*b* output from the first odd-numbered output line odd 1*b* of the first stage circuit ST[1] of the second gate driver 140*b* connected to the first even-numbered output line even 1*a*. Thus, the output pulse signal Even 1*a* and the output pulse signal Odd 1*b* may have the same period and the same magnitude.

An output pulse signal Odd (m)a output from the m-th odd-numbered output line odd (m)a of the m-th stage circuit ST[m] of the first gate driver 140*a* may be the same as an output pulse signal Even m(b) output from the m-th even-numbered output line even m(b) of the m-th stage circuit ST[m] of the second gate driver 140*b* connected to the m-th odd-numbered output line odd (m)a. Thus, the output pulse signal Odd (m)a and the output pulse signal Even m(b) may have the same period and the same magnitude.

The display panel on signal POS may be issued when the light-emissive display device is powered on. The display panel on signal POS may be commonly supplied to all of the stage circuits implemented in the gate driver circuit 140. Accordingly, all of the stage circuits implemented in the gate driver circuit 140 may be simultaneously initialized or rested by the display panel on signal POS having a high voltage level.

The plurality of gate driving clocks GDC may include a plurality of carry shift clocks CRCLK[1] to CRCLK[x] having different phases or having sequentially shifted phases, a plurality of scan shift clocks SCCLK[1] to SCCLK[x] having different phases or having sequentially shifted phases, and a plurality of sense shift clocks SECLK[1] to SECLK[x] having different phases or sequentially shifted phases, and the like.

Each of the carry shift clocks CRCLK[1] to CRCLK[x] may refer to a clock signal for generating a carry signal. Each of the scan shift clocks SCCLK[1] to SCCLK[x] may refer to a clock signal for generating a scan signal having a scan pulse. Each of the sense shift clocks SECLK[1] to SECLK[x] may refer to a clock signal for generating a sense signal having a sense pulse.

Each of the scan shift clocks SCCLK[1] to SCCLK[x] and the sense shift clocks SECLK[1] to SECLK[x] may swing between high and low voltages. A swing voltage width of each of the carry shift clocks according to one example may be larger than a swing voltage width of each of the scan shift clocks SCCLK[1] to SCCLK[x] and the sense shift clocks SECLK[1] to SECLK[x].

During the display mode, each of the scan shift clocks SCCLK[1] to SCCLK[x] and the sense shift clocks SECLK[1] to SECLK[x] may swing between high and low voltages. During the sensing mode, a specific scan shift clock SCCLK[1] among the scan shift clocks SCCLK[1] to SCCLK[x] may swing to correspond to third and fourth scan pulses SCP3 and SCP4, and the rest thereof may maintain a low voltage level. During the sensing mode, a specific sense shift clock SECLK[1] among the sense shift clocks SECLK[1] to SECLK[x] may swing to correspond to a second sense pulse SEP2 shown in FIG. 5, and the rest thereof may maintain a low voltage level. The clocks may partially overlap each other to secure a sufficient charging time during a high-speed operation. High voltage periods of adjacent clocks may overlap each other by a preset period.

Figure 7:
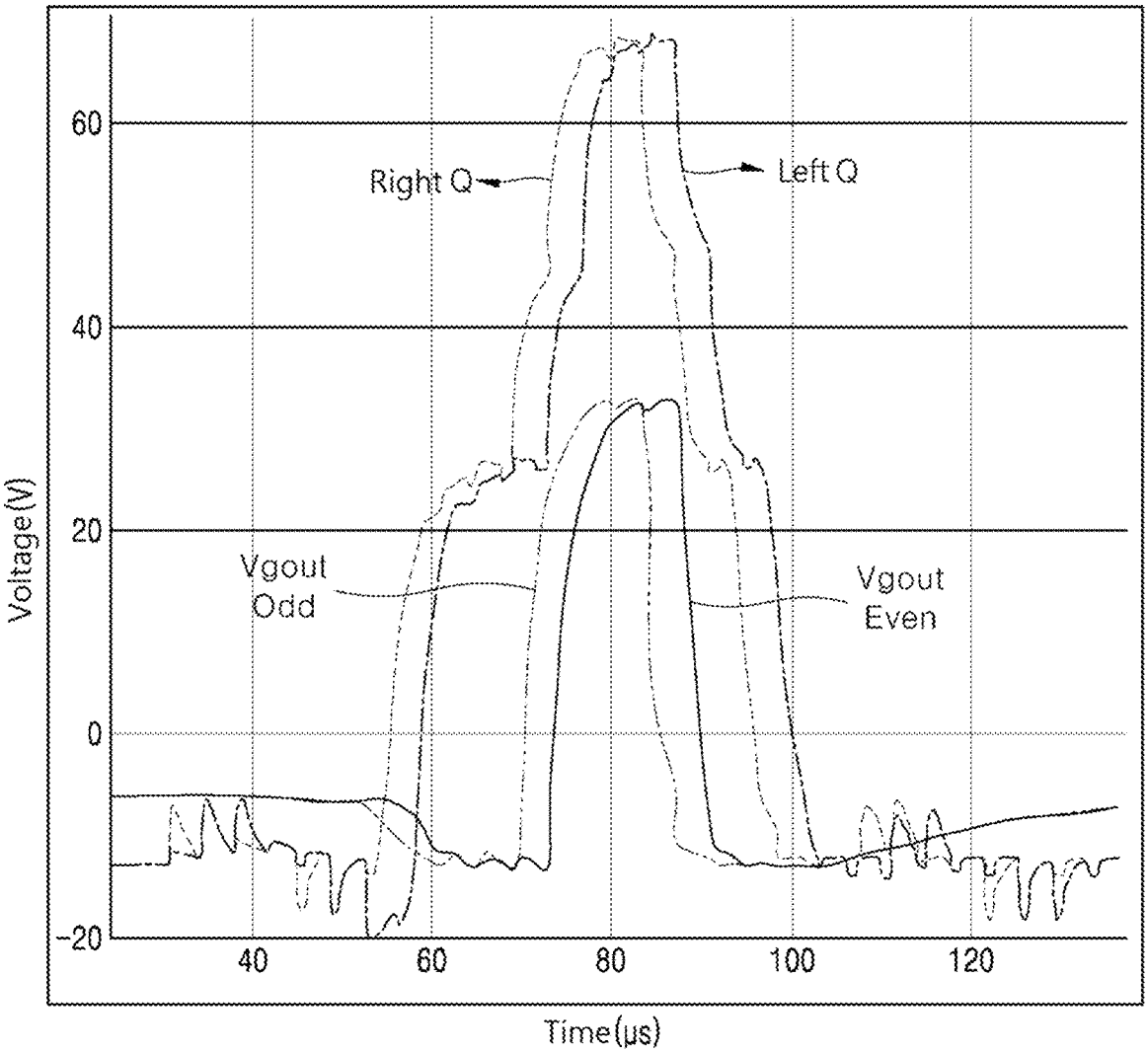
FIG. 7 is a graph showing a voltage difference between output lines when an odd-numbered output line of a gate driver on one side and an even-numbered output line of a gate driver on the opposite side are connected to each other, and an even-numbered output line of the gate driver on one side and an odd-numbered output line of the gate driver on the opposite side are connected to each other in a display device according to an embodiment of the present disclosure.

As described above, in the display device 100 according to the present disclosure, the odd-numbered output line of each stage STan of the first gate driver 140*a* may be connected to the even-numbered output line of each stage STbn of the second gate driver 140*b*, while the even-numbered output line of each stage STan of the first gate driver 140*a* may be connected to the odd-numbered output line of each stage STbn of the second gate driver 140*b*. Thus, as shown in FIG. 7, output delays Delay of the odd output line and the even output line in the Q node around a panel (PNL) center may be equal to each other. FIG. 7 is a graph showing a voltage difference between output lines when an odd-numbered output line of a gate driver on one side and an even-numbered output line of a gate driver on the opposite side are connected to each other, and an even-numbered output line of the gate driver on one side and an odd-numbered output line of the gate driver on the opposite side are connected to each other in a display device according to an embodiment of the present disclosure.

Each of the first gate driver and the second gate driver may further include a front dummy stage circuitry disposed in front of a first stage, and a rear dummy stage circuitry disposed in rear of an m-th stage. The front dummy stage circuitry may be configured to sequentially generate a plurality of front carry signals in response to a gate start signal and supply the plurality of front carry signals as a front carry signal or a gate start signal to one of rear stages. The rear dummy stage circuitry may be configured to sequentially generate a plurality of rear carry signals in response to the gate start signal and supply the plurality of rear carry signals as a rear carry signal or a stage rest signal to one of front stages. It should be understood that "rear stages" includes the meaning of any stage following the front dummy stage circuitry, and "front stages" includes the meaning of any stage preceding the rear dummy stage circuitry. For example, as shown in FIG. 5, the stage ST[1] of the first gate driver 140*a* follows the front dummy stage circuitry DSTP1, and precedes the rear dummy stage circuitry DSPT2.

The second gate driver may further include a zero stage such that the second gate driver starts to operate earlier by half a period or one period than the first gate driver starts to operate.

Although not shown in the drawing, each stage may supply a gate signal to each gate line, and may include a M node, a Q1 node, a Q2 node, and a QB node.

Each stage may include a line selector, the Q1 node, a Q1 node stabilizer, an inverter, a QB node stabilizer, a gate signal output module, a carry signal output module.

The line selector may be configured to: charge the M node based on a front end carry signal, in response to an input of a line sensing preparation signal; and charge the Q1 node to a first high-potential voltage level in response to an input of a rest signal; or discharge the Q1 node to a third low-potential voltage level in response to an input of a panel on signal.

The Q1 node controller may be configured to: charge the Q1 node to the first high-potential voltage level in response to an input of the front end carry signal; and discharge the Q1 node to the third low-potential voltage level in response to an input of a rear end carry signal.

The Q1 node stabilizer may be configured to discharge the Q1 node to the third low-potential voltage level when the QB node has been charged to a second high-potential voltage level.

The inverter may be configured to change a voltage level of the QB node based on a voltage level of the Q1 node.

The QB node stabilizer may be configured to discharge the QB node to a fourth low-potential voltage level in response to an input of the rear end carry signal, an input of the rest signal, and an charged voltage of the M node.

The gate signal output module may be configured to output a gate signal, based on a voltage level of a scan clock signal or the first low-potential voltage level, according to a voltage level of the Q1 node or a voltage level of the QB node.

The carry signal output module may be configured to output a carry signal, based on a voltage level of a carry clock signal or the fourth low-potential voltage level, according to a voltage level of the Q2 node or a voltage level of the QB node.

The first low-potential voltage level, the third low-potential voltage level, and the fourth low-potential voltage level may be different from each other.

The line selector may include a sixth transistor connected to a connection point between the Q1 node and a third low-potential voltage terminal and may be configured to discharge the Q1 node to the third low-potential voltage level in response to an input of the panel on signal.

The Q1 node controller may include a first transistor and a second transistor. The first transistor may be connected to a connection point between the first high-potential voltage terminal and the Q1 node and configured to charge the Q1 node to the first high-potential voltage level in response to an input of the front end carry signal. The second transistor may be connected to a connection point between the Q1 node and the third low-potential voltage terminal and configured to discharge the Q1 node to the third low-potential voltage level in response to an input of the rear end carry signal.

The Q1 node stabilizer may include a first transistor connected to a connection point between the Q1 node and the third low-potential voltage terminal and configured to discharge the Q1 node to the third low-potential voltage level when the QB node has been charged to the second high-potential voltage level.

The inverter may include a fifth transistor connected to a connection point and disposed between the QB node and the fourth low-potential voltage terminal and configured to discharge the QB node to the fourth low-potential voltage when the Q2 node has been charged to the first high-potential voltage level. In one or more embodiments, the inverter is configured to change the voltage level of the QB node to the fourth low-potential voltage when the voltage level of the Q1 node has been charged to the first high-potential voltage level.

The inverter may include a fourth transistor connected to a connection point and disposed between a second connection node and the second low-potential voltage terminal. A voltage level of the second low-potential voltage terminal is different from each of the voltage level of the first low-potential voltage terminal, the third low-potential voltage terminal, and the fourth low-potential voltage terminal.

Each stage may further include a Q2 node controller configured to charge the Q2 node to the first high-potential voltage level when the Q1 node has been charged to the first high-potential voltage level and discharge the Q2 node to the fourth low-potential voltage level when the QB node has been charged to the second high-potential voltage level.

The Q2 node controller may include a first transistor connected to a connection point between the first high-potential voltage terminal and the Q2 node and configured to charge the Q2 node to the first high-potential voltage level when the Q1 node has been charged to the first high-potential voltage level and a second transistor connected to a connection point between the Q2 node and the fourth low-potential voltage terminal and configured to discharge the Q2 node to the fourth low-potential voltage level when the QB node has been charged to the second high-potential voltage level.

In general, an output time duration of the N-th output line Vgout [N] of the gate driver circuit is 1.53 μs, and an output time duration of the (N+1)-th output line Vgout [N+1] is 1.90 μs. Therefore, the output time difference between N-th output line Vgout [N] and (N+1)-th output line Vgout [N+1] is 0.37 μs. However, in the display device 100 according to an embodiment of the present disclosure, the output time duration of the N-th output line Vgout [N] of the gate driver circuit 140 is 1.70 μs, and the output time duration of the (N+1)-th output line Vgout [N+1] is 1.71 μs. Therefore, the output time difference between the N-th output line Vgout [N] and the (N+1)-th output line Vgout [N+1] is 0.01 μs. Therefore, according to an embodiment of the present disclosure, it could be identified that the output related difference between the odd output line and the even output line of the gate driver circuit 140 is reduced, compared to that in the conventional scheme.

As described above, according to the present disclosure, the gate driver circuit and the display device including the same which may reduce the voltage difference between the output lines of the gate driver circuit in the display device having a liquid crystal display panel or an OLED display panel may be realized.

Therefore, according to the present disclosure, when the output stage Q Node merge structure is used, the output related difference between the output lines in the Q Node may be minimized or reduced.

Further, in the display device according to an embodiment of the present disclosure, an odd stage of a left GIP and an even stage of a right GIP in a two line Q node merge structure may be connected to each other, such that the GIP output characteristics of the even line and the odd line around the panel (PNL) center may be equal to each other.

The output related difference between the output lines may increase as a size of the thin-film transistor decreases according to a panel load. However, according to the present disclosure, the output related difference between the output lines may be minimized or reduced. Moreover, the device according to the present disclosure may be advantageous in a smaller area GIP design.

Although the embodiments of the present disclosure have been described in more detail with reference to the accompanying drawings, the present disclosure is not necessarily limited to these embodiments. The present disclosure may be implemented in various modified manners within the scope not departing from the technical idea of the present disclosure. Accordingly, the embodiments disclosed in the present disclosure are not intended to limit the technical idea of the present disclosure, but to describe the present disclosure. The scope of the technical idea of the present disclosure is not limited by the embodiments. Therefore, it should be understood that the embodiments as described above are illustrative and non-limiting in all respects. The scope of protection of the present disclosure should be interpreted by the claims, and all technical ideas within the scope of the present disclosure should be interpreted as being included in the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A gate driver circuit for a display device, the gate driver circuit comprising:

a first gate driver disposed on a first side of a display panel; and a second gate driver disposed on a second side of the display panel, the second side being opposite the first side, wherein an odd-numbered output line of the first gate driver is connected to an even-numbered output line of the second gate driver, wherein an even-numbered output line of the first gate driver is connected to an odd-numbered output line of the second gate driver, wherein the gate driver circuit is arranged in a non-display area of the display panel in the form of a thin-film pattern and in a gate-in-panel.

2. The gate driver circuit of claim 1, wherein each of the first gate driver and the second gate driver includes at least one stage, wherein each stage includes two output lines including an odd-numbered output line and an even-numbered output line, wherein the odd-numbered output line of each stage of the first gate driver is connected to the even-numbered output line of a respective stage of the second gate driver, wherein the even-numbered output line of each stage of the first gate driver is connected to the odd-numbered output line of a respective stage of the second gate driver.

3. The gate driver circuit of claim 1, wherein each of the first gate driver and the second gate driver includes at least one stage, wherein each stage includes four output lines including odd-numbered output lines and even-numbered output lines, wherein the odd-numbered output lines of each stage of the first gate driver are connected to the even-numbered output lines of at least one respective stage of the second gate driver, wherein the even-numbered output lines of each stage of the first gate driver are connected to the odd-numbered output lines of at least one respective stage of the second gate driver.

4. The gate driver circuit of claim 2, wherein each of the first gate driver and the second gate driver further includes a front dummy stage circuitry disposed in front of a first stage, and a rear dummy stage circuitry disposed in rear of an m-th stage, wherein the front dummy stage circuitry is configured to:

sequentially generate a plurality of front carry signals in response to a gate start signal; and supply the plurality of front carry signals as a front carry signal or a gate start signal to one of rear stages, and wherein the rear dummy stage circuitry is configured to:

sequentially generate a plurality of rear carry signals in response to the gate start signal; and supply the plurality of rear carry signals as a rear carry signal or a stage rest signal to one of front stages.

5. The gate driver circuit of claim 4, wherein the second gate driver further includes a zero stage such that the second gate driver starts to operate earlier by half a period or one period than the first gate driver starts to operate.

6. A display device, comprising:

a display panel including sub-pixels, the sub-pixels being respectively arranged at regions of overlap between gate lines and data lines;

a gate driver circuit for supplying a scan signal to each of the gate lines, wherein the gate driver circuit includes a first gate driver disposed on one side of the display panel and a second gate driver disposed on a side of the display panel, the side being opposite the one side;

a data driver circuit for supplying a data voltage to each of the data lines; and a timing controller configured to control operation of each of the gate driver circuit and the data driver circuit, wherein an odd-numbered output line of the first gate driver is connected to an even-numbered output line of the second gate driver, wherein an even-numbered output line of the first gate driver is connected to an odd-numbered output line of the second gate driver, wherein the gate driver circuit is arranged in a non-display area of the display panel in the form of a thin-film pattern and in a gate-in-panel.

* * * * *